US006113256A

United States Patent [19]

Bonissone et al.

[11] Patent Number: 6,113,256

[45] Date of Patent: Sep. 5, 2000

[54] SYSTEM AND METHOD FOR PROVIDING RAW MIX PROPORTIONING CONTROL IN A CEMENT PLANT WITH A FUZZY LOGIC SUPERVISORY CONTROLLER

[75] Inventors: Piero Patrone Bonissone, Schenectady; Yu-To Chen, Niskayuna, both of N.Y.

[73] Assignee: General Electric Company, Schenectady, N.Y.

[21] Appl. No.: 09/189,153

[22] Filed: Nov. 9, 1998

[51] Int. Cl.[7] ..... B28C 7/06

[52] U.S. Cl. ..... 366/8; 366/16; 366/152.1; 700/265; 706/906

[58] Field of Search ..... 366/16, 17, 8, 366/29, 6, 2, 30, 33, 37, 140, 142, 152.1; 706/900, 906; 700/265, 50

[56] References Cited

U.S. PATENT DOCUMENTS

| | | | |
|---|---|---|---|
| 3,048,335 | 8/1962 | Burhans et al. | 700/265 |
| 3,186,596 | 6/1965 | Badgett | 700/265 |
| 3,473,008 | 10/1969 | Bay et al. | 700/265 |
| 3,609,316 | 9/1971 | Brosset | 700/265 |
| 4,151,588 | 4/1979 | Hammer | 700/265 |
| 4,318,177 | 3/1982 | Rapp et al. | 700/265 |
| 4,701,838 | 10/1987 | Swinkles et al. | 700/44 |
| 5,272,621 | 12/1993 | Aoki | 700/900 |
| 5,320,425 | 6/1994 | Stephenson et al. | 366/1 |
| 5,452,213 | 9/1995 | Ito et al. | 366/8 |
| 5,452,954 | 9/1995 | Handke et al. | 366/16 |
| 5,590,976 | 1/1997 | Kilheffer et al. | 366/8 |
| 5,754,423 | 5/1998 | Teutenberg et al. | 700/28 |

FOREIGN PATENT DOCUMENTS

| | | | |
|---|---|---|---|
| 4-125108 | 4/1992 | Japan | 366/16 |
| 592454 | 2/1978 | U.S.S.R. | 366/16 |

*Primary Examiner*—Tony G. Soohoo
*Attorney, Agent, or Firm*—David C. Goldman; Jill M. Breedlove

[57] ABSTRACT

A system and method for providing raw mix proportioning control in a cement plant with a fuzzy logic supervisory controller. A raw mix proportioning controller determines the correct mix and composition of raw materials to be transported to a mixer. The raw mix proportioning controller uses the fuzzy logic supervisory controller to determine the proper mix and composition of raw materials. The fuzzy logic supervisory controller takes targeted set points and the chemical composition of the raw material as inputs and generates the proportions of the raw material to be provided as an output for the next time step.

22 Claims, 8 Drawing Sheets

| e | NM | NS | ZE | PS | PM | Δe |
|---|---|---|---|---|---|---|
| | ZE | NS | NM | NB | NB | PM |
| | PS | ZE | NS | NM | NB | PS |
| | PM | PS | ZE | NS | NM | ZE |
| | PB | PM | PS | ZE | NS | NS |
| | PB | PB | PM | PS | ZE | NM |

SYSTEM AND METHOD FOR PROVIDING RAW MIX PROPORTIONING CONTROL IN A CEMENT PLANT WITH A FUZZY LOGIC SUPERVISORY CONTROLLER

BACKGROUND OF THE INVENTION

This invention relates generally to a cement plant and more particularly to providing raw mix proportioning control in a cement plant.

A typical cement plant uses raw material such as limestone, sandstone and sweetener to make cement. Transport belts (e.g. weighfeeders) transport each of the three raw materials to a mixer which mixes the materials together. A raw mill receives the mixed material and grinds and blends it into a powder, known as a "raw mix". The raw mill feeds the raw mix to a kiln where it undergoes a calcination process. In order to produce a quality cement, it is necessary that the raw mix produced by the raw mill have physical properties with certain desirable values. Some of the physical properties which characterize the raw mix are a Lime Saturation Factor (LSF), a Alumina Modulus (ALM) and a Silica Modulus (SIM). These properties are all known functions of the fractions of four metallic oxides (i.e., calcium, iron, aluminum, and silicon) present in each of the raw materials. Typically, the LSF, ALM and SIM values for the raw mix coming out of the raw mill should be close to specified set points.

One way of regulating the LSF, ALM and SIM values for the raw mix coming out of the raw mill to the specified set points is by providing closed-loop control with a proportional controller. Typically, the proportional controller uses the deviation from the set points at the raw mill as an input and generates new targeted set points as an output for the next time step. Essentially, the closed-loop proportional controller is a conventional feedback controller that uses tracking error as an input and generates a control action to compensate for the error. One problem with using the closed-loop proportional controller to regulate the LSF, ALM and SIM values for the raw mix coming out of the raw mill is that there is too much fluctuation from the targeted set points. Too much fluctuation causes the raw mix to have an improper mix of the raw materials which results in a poorer quality cement. In order to prevent a fluctuation of LSF, ALM and SIM values for the raw mix coming out of the raw mill, there is a need for a system and a method that can ensure that there is a correct mix and composition of raw materials for making the cement.

BRIEF SUMMARY OF THE INVENTION

In a first embodiment of this invention there is a system for providing raw mix proportioning control in a cement plant. In this embodiment, there is a plurality of raw material and a plurality of transport belts for transporting the material. A raw mix proportion controller, coupled to the plurality of raw material and the plurality of transport belts, controls the proportions of the raw material transported along the transport belts. The raw mix proportion controller comprises a fuzzy logic supervisory controller that uses a plurality of target set points and the composition of the plurality of raw material as inputs and generates a control action to each of the plurality of transport belts that is representative of the proportions of the material to be transported along the belt. A mixer, coupled to the plurality of transport belts, mixes the proportions of each of the plurality of raw material transported therefrom.

In a second embodiment of this invention there is a method for providing raw mix proportioning control in a cement plant. In this embodiment, a plurality of raw material are transported with a plurality of transport belts to a mixer. Proportions of the plurality of raw material transported along the plurality of transport belts to the mixer are controlled by obtaining a plurality of target set points and the composition of the plurality of raw material. Fuzzy logic supervisory control is performed on the plurality of target set points and the composition of the plurality of raw material. The proportions of the plurality of raw material transported along the plurality of transport belts to the mixer are determined according to the fuzzy logic supervisory control. The determined proportions of the plurality of raw material are sent to the mixer for mixing.

DETAILED DESCRIPTION OF THE INVENTION

Figure 1:
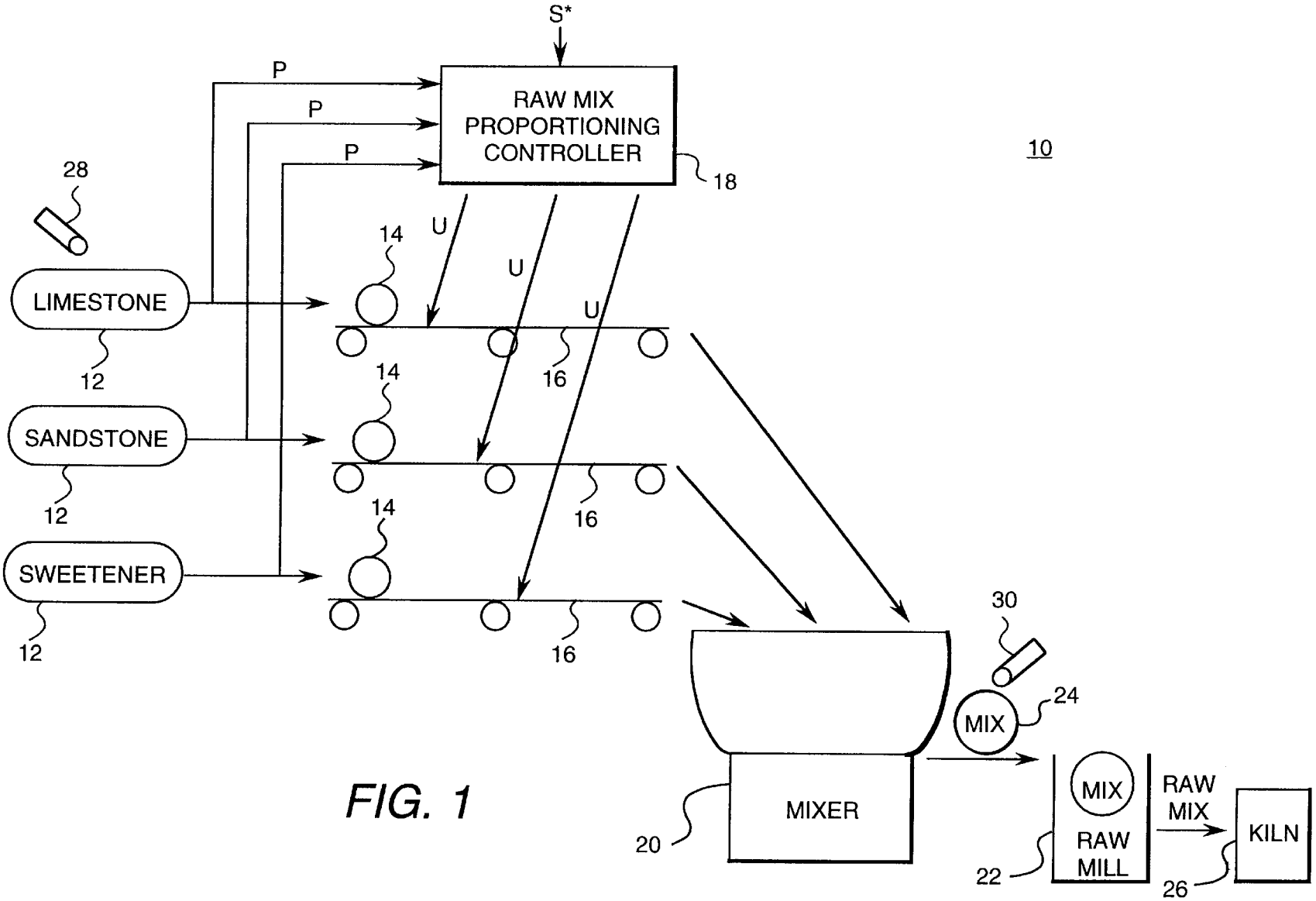
FIG. 1 shows a block diagram of a system for providing raw mix proportioning control in a cement plant according to this invention.

FIG. 1 shows a block diagram of a system 10 for providing raw mix proportioning control in a cement plant according to this invention. The raw mix proportioning control system 10 comprises a plurality of raw material 12 such as limestone, sandstone and sweetener to make cement. In addition, moisture can be added to the raw materials. While these materials are representative of a suitable mixture to produce a cement raw mix, it should be clearly understood that the principles of this invention may also be applied to other types of raw material used for manufacturing cement raw mix. Containers 14 of each type of raw material move along a transport belt 16 such as a weighfeeder. A raw mix proportioning controller 18 controls the proportions of each raw material 12 transported along the transport belts 16. A mixer 20 mixes the proportions of each raw material 12 transported along the transport belts 16. A raw mill 22 receives mixed material 24 from the mixer 20 and grinds and blends it into a raw mix. The raw mill 22 feeds the raw mix to a kiln 26 where it undergoes a calcination process.

As mentioned above, it is necessary that the raw mix produced by the raw mill 22 have physical properties with certain desirable values. In this invention, the physical properties are the LSF, ALM and SIM. These properties are all known functions of the fractions of four metallic oxides (i.e., calcium, iron, aluminum, and silicon) present in each of the raw materials. A sensor 28, such as an IMA QUARCONTM sensor, located at one of the transport belts 16 for conveying the limestone, measures the calcium, iron, aluminum and silicon present in the limestone. Those skilled in the art will recognize that more than one sensor can be used with the other raw materials if desired. Typically, the LSF, ALM and SIM values for the raw mix coming out of the raw mill should be close to specified target set points. Another sensor 30 such as an IMA IMACONTM sensor located before the raw mill 22 measures the calcium, iron, aluminum and silicon present in the mix 24. Although this invention is described with reference to LSF, ALM and SIM physical properties, those skilled in the art will recognize that other physical properties that characterize the raw mix are within the scope of this invention.

The raw mix proportioning controller 18 continually changes the proportions of the raw material 12 in which the material are mixed prior to entering the raw mill 22 so that the values of LSF, ALM and SIM are close to the desired set points and fluctuate as little as possible. The raw mix proportioning controller 18 uses fuzzy logic supervisory control to continually change the proportions of the raw material. In particular, the fuzzy logic supervisory control uses targeted set points and the chemical composition of the raw material as inputs and generates control actions to continually change the proportions of the raw material. The mixer 20 mixes the proportions of the raw material as determined by the fuzzy logic supervisory control and the raw mill 22 grinds the mix 24 into a raw mix.

Figure 2:
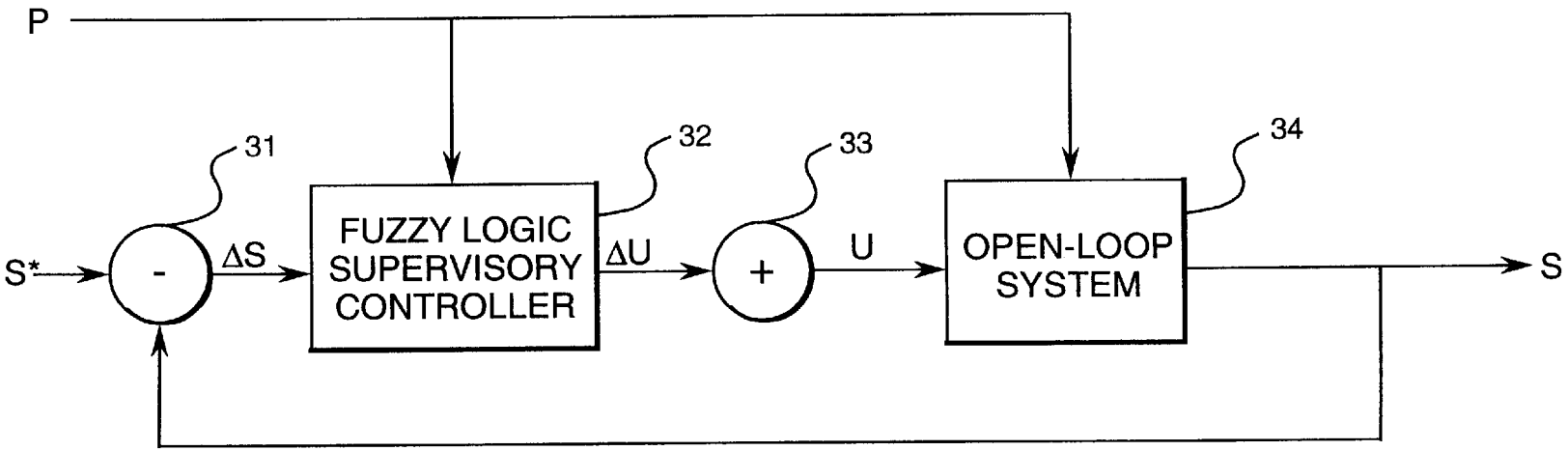
FIG. 2 shows a schematic of the fuzzy logic supervisory control provided by the raw mix proportioning controller shown in FIG. 1 according to this invention.

FIG. 2 shows a schematic of the fuzzy logic supervisory control provided by the raw mix proportioning controller 18. There are two main components to the fuzzy logic supervisory control provided by the raw mix proportioning controller; a fuzzy logic supervisory controller 32 and an open-loop system 34. The fuzzy logic supervisory control takes S* and P as inputs and generates S as an output, where S* is the targeted set points, P is the process composition matrix of the raw materials, and S is the actual set points. A more detailed discussion of these variables is set forth below. At each time step, the fuzzy logic supervisory control attempts to eliminate the tracking error, which is defined as;

$$\Delta S(t)=S^*-S(t) \tag{1}$$

by generating ΔU(t), the change in control action, which results in proper control action for the next time step which is defined as:

$$U(t+1)=\Delta U(t)+U(t) \tag{2}$$

More specifically, the fuzzy logic supervisory controller 32 uses gradient information to produce change in control to compensate the tracking error. In FIG. 2, a subtractor 31 performs the operation of equation 1 and a summer 33 performs the operation of equation 2.

Figure 3:
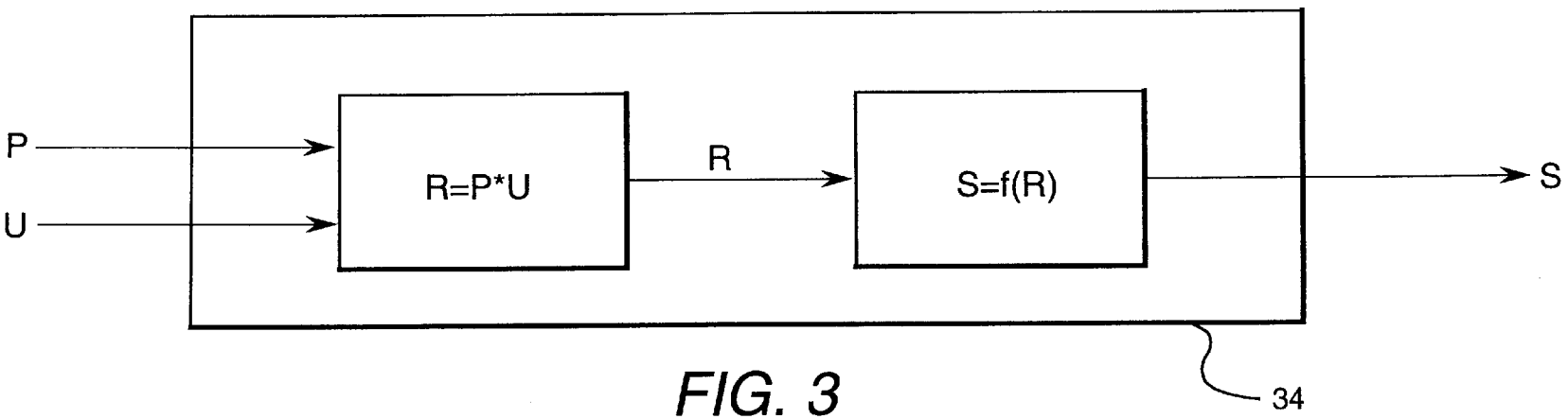
FIG. 3 shows a more detailed schematic of the open-loop system shown in FIG. 2.

FIG. 3 shows a more detailed diagram of the open-loop system 34 shown in FIG. 2. The open-loop system 34 receives P and U as inputs and generates S as an output, where P is a process composition matrix of size 4 by 3, U is a control variable matrix of size 3 by 1, S is the actual set point matrix of size 3 by 1, and R is a weight matrix of size 4 by 1.

The process composition matrix P represents the chemical composition (in percentage) of the input raw material (i.e., limestone, sandstone and sweetener) and is defined as:

$$P=\begin{bmatrix} c_1 & c_2 & c_3 \\ s_1 & s_2 & s_3 \\ a_1 & a_2 & a_3 \\ f_1 & f_2 & f_3 \end{bmatrix} \tag{3}$$

Column 1 in matrix P represents the chemical composition of limestone, while columns 2 and 3 in P represent sandstone and sweetener, respectively. This invention assumes that only column 1 in P varies over time, while columns 2 and 3 are considered constant at any given day. Row 1 in matrix P represents the percentage of the chemical element CaO present in the raw material, while rows 2, 3, and 4 represent the percentage of the chemical elements $S_iO_2$, $Al_2O_3$ and $Fe_2O_3$, respectively, present in the raw materials.

The control variable vector U represents the proportions of the raw material (i.e., limestone, sandstone and sweetener) used for raw mix proportioning. The matrix U is defined as:

$$U=\begin{bmatrix} u_1 \\ u_2 \\ u_3 \end{bmatrix} \tag{4}$$

wherein $u_3=1-u_1-u_2$.

The set point vector S contains the set points LSF, SIM and ALM and is defined as:

$$S=\begin{bmatrix} LSF \\ SIM \\ ALM \end{bmatrix} \tag{5}$$

The weight matrix R is defined as:

$$R=\begin{bmatrix} C \\ S \\ A \\ F \end{bmatrix} \tag{6}$$

wherein C, S, A and F are the weight of CaO, $S_iO_2$, $Al_2O_3$ and $Fe_2O_3$, respectively, and R is derived by multiplying P by U. A function f takes R as input and generates S as output. The function f comprises three simultaneous non-linear equations defined as follows:

$$LSF=\frac{C}{2.8\cdot S+1.18\cdot A+0.6\cdot F} \tag{7}$$

$$SIM=\frac{S}{A+F} \tag{8}$$

$$ALM=\frac{A}{F} \tag{9}$$

wherein:

$$C=c_1\cdot u_1+c_2\cdot u_2+c_3\cdot(1-u_1-u_2) \tag{10}$$

$$s=s_1\cdot u_1+s_2\cdot u_2+s_3\cdot(1-u_1-u_2) \tag{11}$$

$$A=a_1\cdot u_1+a_2\cdot u_2+a_3\cdot(1-u_1-u_2) \tag{12}$$

$$F=f_1\cdot u_1+f_2\cdot u_2+f_3\cdot(1-u_1-u_2) \tag{13}$$

and $u_1$, $u_2$ and $u_3=1-u_1-u_2$ are the dry basis ratio of limestone, sandstone and sweetener, respectively.

Furthermore, $c_i$, $s_i$, $a_i$ and $f_i$ are the chemical elements of process matrix P defined in equation 3.

Figure 4:
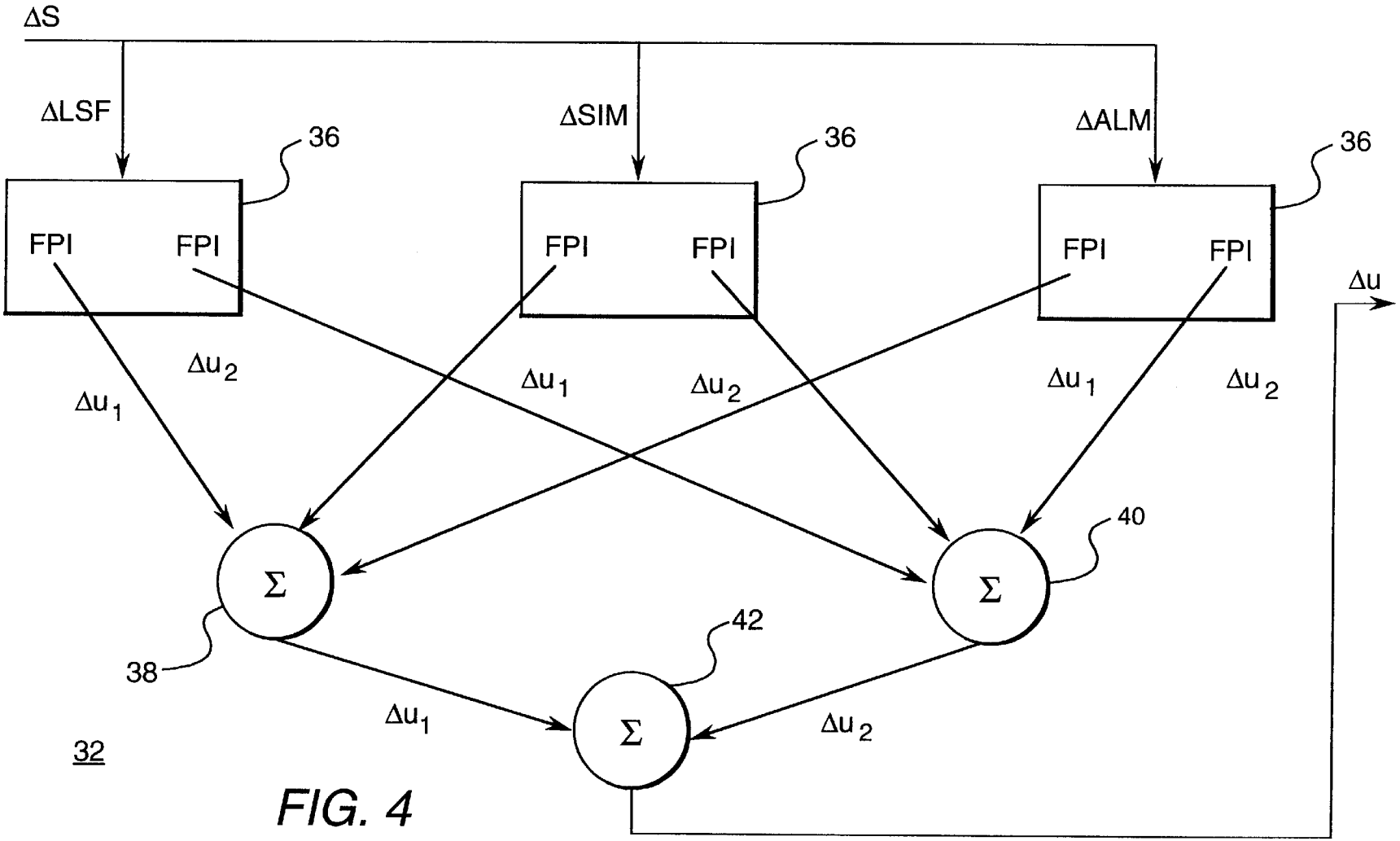
FIG. 4 shows a more detailed view of the fuzzy logic supervisory controller shown in FIG. 2.

FIG. 4 shows a more detailed diagram of the fuzzy logic supervisory controller 32 shown in FIG. 2. The fuzzy logic supervisory controller 32 comprises a plurality of low level controllers 36, wherein each low level controller 36 receives a change in a target set point ΔS as an input and generates a change in a control action ΔU as an output. The plurality of low level controller are preferably fuzzy proportional integral (FPI) controllers, however, other types of fuzzy logic controllers are within the scope of this invention. In the preferred embodiment, as shown in FIG. 4, the fuzzy logic supervisory controller 32 comprises at least three pairs of FPI controllers 36, wherein each of the at least three pairs of low level controllers receives a change in a target set point ΔS as an input and generates a change in a control action ΔU as an output. As shown in FIG. 4, one pair of the FPI controllers receives the change in lime saturation factor ΔLSF as the input, a second pair of the FPI controllers receives silica modulus ΔSIM as the input, and a third pair of the FPI controllers receives alumina modulus ΔALM as the input. As mentioned above, each FPI controller in a pair of the FPI controllers generates a change in a control action as an output. More specifically, one FPI controller in a pair generates a change in control action $\Delta u_1$ as one output and the other FPI controller in the pair generates a change in control action $\Delta u_2$ as a second output. The change in control action $\Delta u_1$ is representative of the dry basis ratio of limestone, while the change in control action $\Delta u_2$ is representative of the dry basis ratio of sandstone.

The fuzzy logic supervisory controller 32 also comprises a first summer 38 and a second summer 40, coupled to each pair of the FPI controllers 36, for summing the change in control actions generated therefrom. In particular, the first summer 38 receives the change in control actions $\Delta u_1$ generated from each pair of the FPI controllers, while the second summer 40 receives the change in control actions $\Delta u_2$ generated from each of the pairs. The first summer 38 sums all of the control actions $\Delta u_1$ together, while the second summer 40 sums all of the control actions $\Delta u_2$ together. A third summer 42, coupled to the first summer 38 and second summer 40 sums together the change in control actions for both $\Delta u_1$ and $\Delta u_2$ and generates the change in control action ΔU therefrom. Essentially, the high level fuzzy logic supervisory controller 32 aggregates the three pairs of low-level FPI controllers to come up with a unified control action. Furthermore, it may provide a weighting function to the above-described aggregation process to determine the trade-off of the overall control objective. For instance, to concentrate on eliminating ΔLSF, more weight would be put on the control action recommended by the first pair of FPI controllers.

Figure 5:
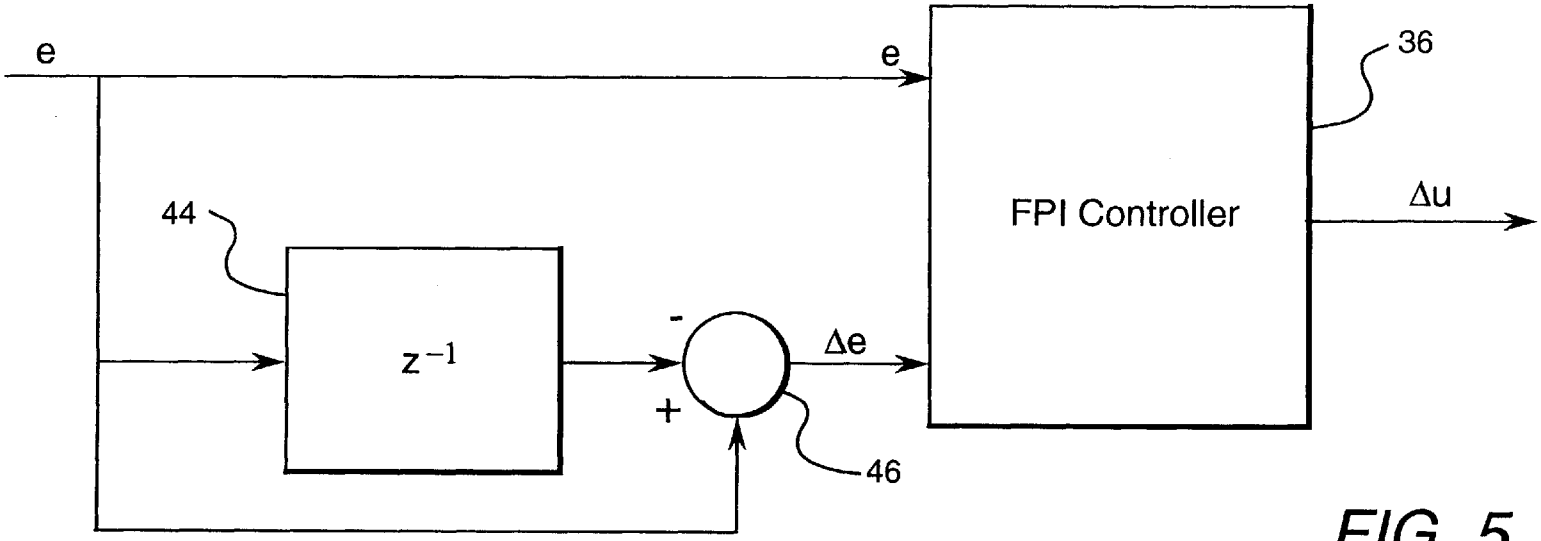
FIG. 5 shows a block diagram of a more detailed view of one of the FPI controllers used in the fuzzy logic supervisory controller.

FIG. 5 shows a block diagram of a more detailed view of one of the FPI controllers 36 used in the fuzzy logic supervisory controller 32. The FPI controller 36 receives error e and change in error Δe as inputs and generates an incremental control action Δu as an output. The error e corresponds to the input ΔS which is ΔLSF, ΔSIM and ΔALM. Thus, an input for one pair of FPI controllers is defined as:

$$e=\Delta LSF=LSF^*-LSF \tag{14}$$

while the input for a second pair of FPI controllers is defined as:

$$e=\Delta SIM=SIM^*-SIM \tag{15}$$

while the input for the third pair of FPI controllers is defined as:

$$e=\Delta ALM=ALM^*-ALM \tag{16}$$

The change in error Δe is defined as:

$$\Delta e=e(t)-e(t-1) \tag{17}$$

wherein e(t) is the error value at time step t, while e(t−1) represent the error value at t−1 time step. Thus, there would be a change in error Δe at each pair of the FPI controllers in the fuzzy logic supervisory controller. As shown in FIG. 5, the change in error Δe for a FPI controller is determined by a delay element (i.e., a sample and hold) 44 and a summer 46.

Figure 6:
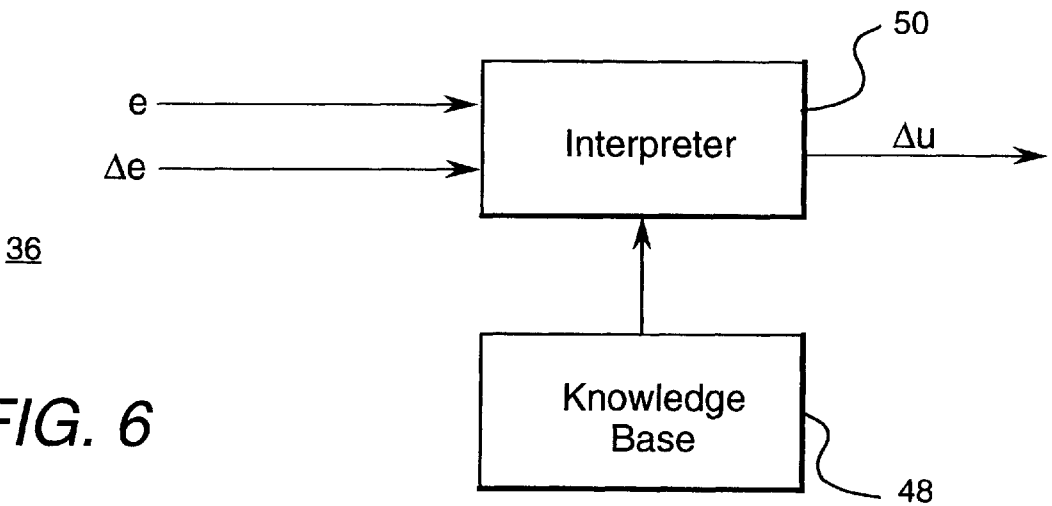
FIG. 6 shows a block diagram of a more detailed view of the FPI controller shown in FIG. 5.

FIG. 6 shows a block diagram of a more detailed view of the FPI controller shown in FIG. 5. The FPI controller 36 as shown in FIG. 6 comprises a knowledge base 48 having a rule set, term sets, and scaling factors. The rule set maps linguistic descriptions of state vectors such as e and Δe into the incremental control actions Δu; the term sets define the semantics of the linguistic values used in the rule sets; and the scaling factors determine the extremes of the numerical range of values for both the input (i.e., e and Δe) and the output (i.e., Δu) variables. An interpreter 50 is used to relate the error e and the change in error Δe to the control action Δu according to the scaling factors, term sets, and rule sets in the knowledge base 48.

Figure 7B:
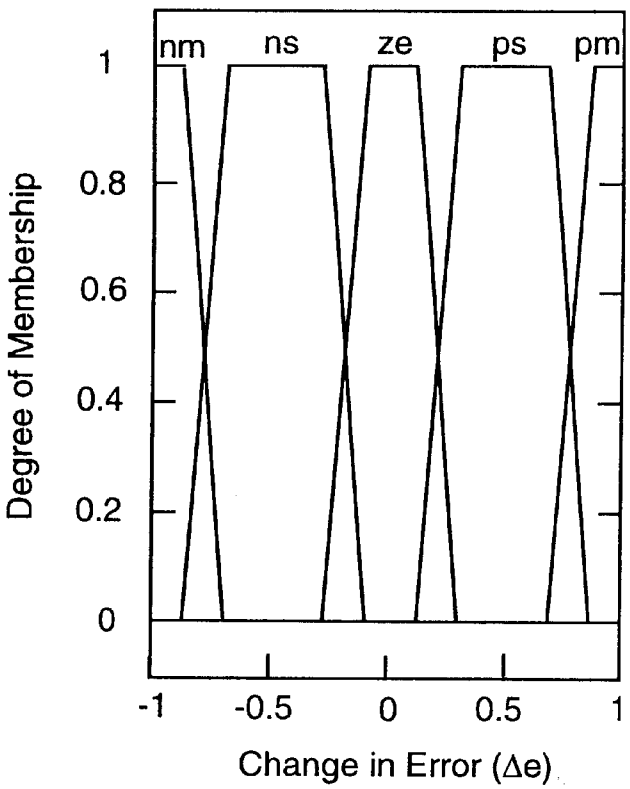
FIGS. 7*a*–7*c* show examples of fuzzy membership functions used in this invention.
Figure 7A:
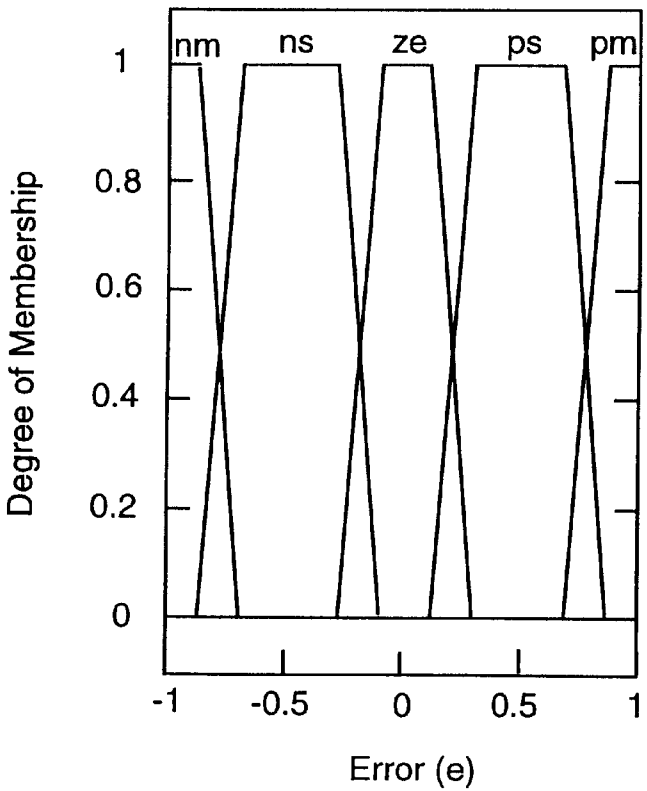
Figures 7C, 8:
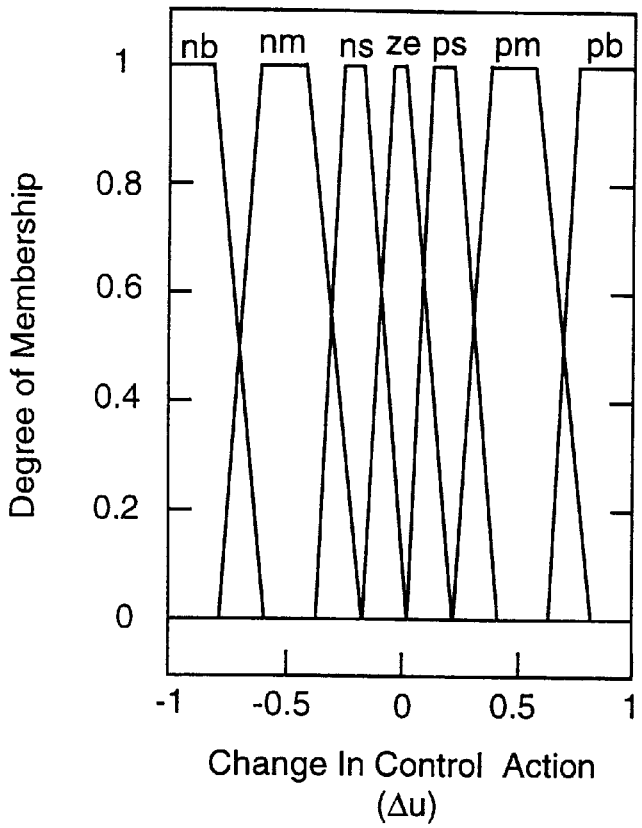
FIG. 8 shows an example of a rule set for a FPI controller according to this invention.

In this invention, each of the input variables (e and Δe) and the output variable (Δu) have a term set. The term sets are separated into sets of NB, NM, NS, ZE, PS, PM and PB, wherein N is negative, B is big, M is medium, S is small, P is positive, and ZE is zero. Accordingly, NB is negative big, NM is negative medium, NS is negative small, PS is positive small, PM is positive medium and PB is positive big. Those skilled in the art will realize that there are other term sets that can be implemented with this invention. Each term set has a corresponding membership function that returns the degree of membership or belief, for a given value of the variable. Membership functions may be of any form, as long as the value that is returned is in the range of [0,1]. FIGS. 7*a*–7*c* show examples of fuzzy membership functions used for the error e, the change in error Δe and the change in control action Δu, respectively.

Figure 9:
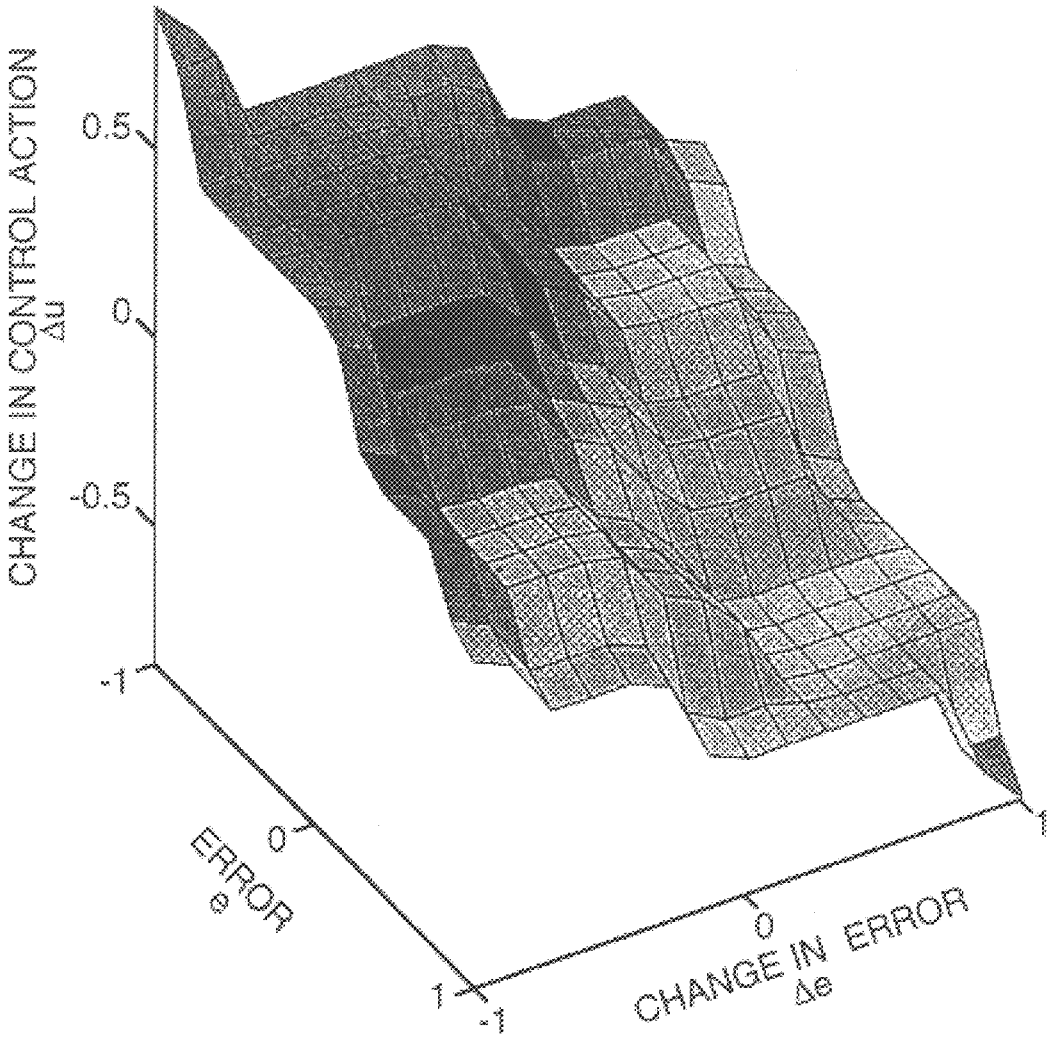
FIG. 9 shows an example of a control surface used in this invention.

An example of a rule set for the FPI controller 36 is shown in FIG. 8. As mentioned above, the rule set maps linguistic descriptions of the error e and the change in error Δe into the control action Δu. In FIG. 8, if e is NM and Δe is PS, then Δu will be PS. Another example is if e is PS and Δe is NS, then Δu will be ZE. Those skilled in the art will realize that there are other rule sets that can be implemented with this invention. FIG. 9 shows an example of a control surface for one of the set points. In particular, FIG. 9 shows a control surface for the control of LSF.

Figure 10:
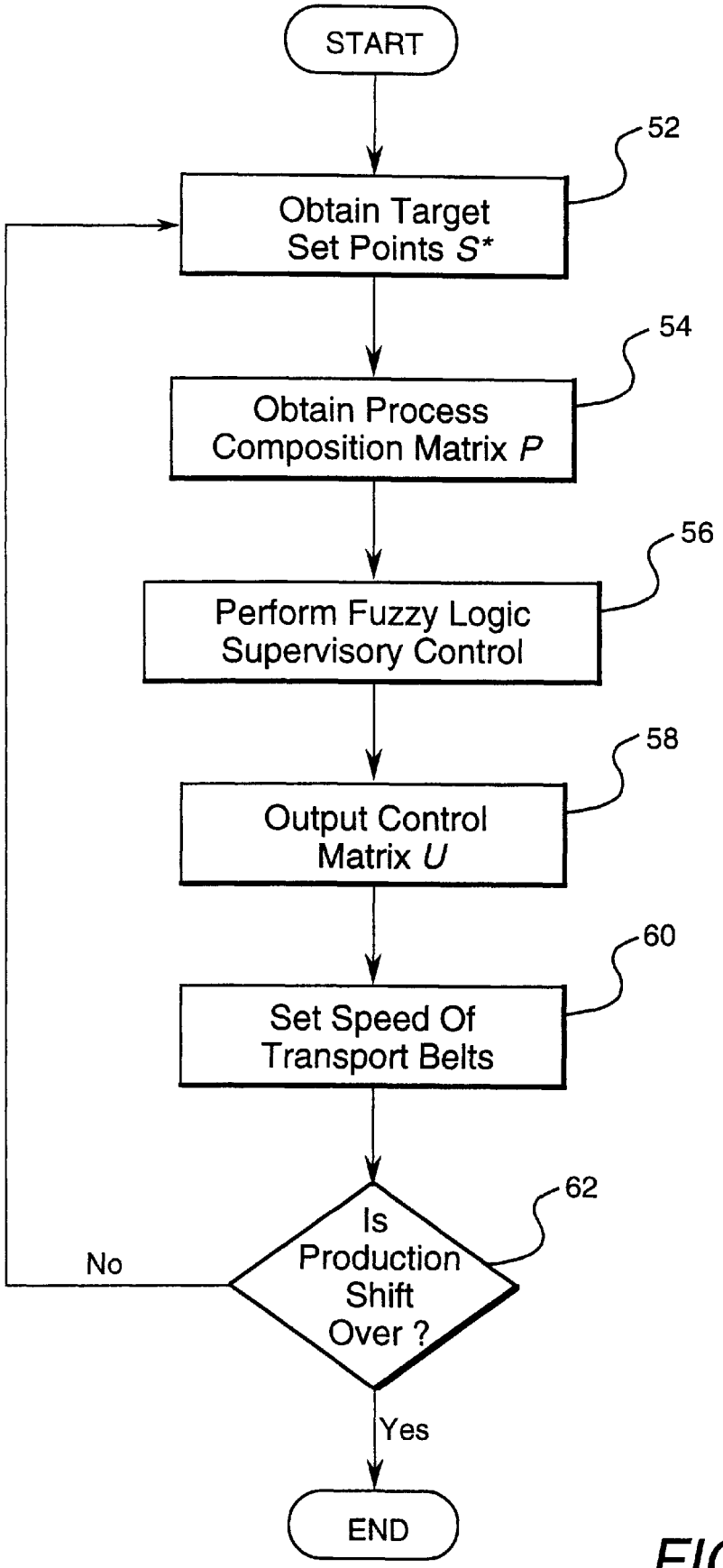
FIG. 10 shows a flow chart setting forth the steps of using fuzzy logic supervisory control to provide raw mix proportioning according to this invention.

FIG. 10 shows a flow chart describing the raw mix proportioning control of this invention according to the fuzzy logic supervisory control. Initially, the raw mix proportioning controller obtains a plurality of target set points S* at 52. Next, the raw mix proportioning controller obtains the process composition matrix P at 54. The raw mix proportioning controller then performs the fuzzy logic supervisory control in the aforementioned manner at 56. The raw mix proportioning controller then outputs the control matrix U at 58 which is the proportion of raw materials. The raw mix proportioning controller then sets the speed of each of the transport belts to provide the proper proportion of raw material at 60 which is in accordance with the control matrix U. These steps continue until the end of the production shift. If there is still more time left in the production shift as determined at 62, then steps 52–60 are repeated, otherwise, the process ends.

It is therefore apparent that there has been provided in accordance with the present invention, a system and method for providing raw mix proportioning control in a cement plant with a fuzzy logic supervisory controller that fully satisfy the aims and advantages and objectives hereinbefore set forth. The invention has been described with reference to several embodiments, however, it will be appreciated that variations and modifications can be effected by a person of ordinary skill in the art without departing from the scope of the invention.

What is claimed is:

1. A system for providing raw mix proportioning control in a cement plant, comprising:

a plurality of raw material;

a plurality of transport belts for transporting the plurality of raw material;

a measuring device that measures the composition of the plurality of raw material transported by the plurality of transport belts;

a raw mix proportioning controller, coupled to the plurality of transport belts and the measuring device, for controlling the proportions of the plurality of raw material transported along the plurality of transport belts, wherein the raw mix proportioning controller comprises a fuzzy logic supervisory controller that uses a plurality of target set points and the composition of the plurality of raw material as inputs and generates a control action to each of the plurality of transport belts that is representative of the proportions of the material to be transported along the belts the fuzzy logic supervisory controller comprising a plurality of low level controllers, wherein each low level controller receives a change in a target set point as an input and generates a change in a control action as an output; and a mixer, coupled to the plurality of transport belts, for mixing the proportions of each of the plurality of raw material transported therefrom.

2. The system according to claim 1, wherein the plurality of raw material comprise limestone, sandstone and sweetener.

3. The system according to claim 1, wherein the plurality of target set points are physical properties comprising lime saturation factor, alumina modulus and silica modulus.

4. The system according to claim 1, wherein the fuzzy logic supervisory controller comprises at least three pairs of low level controllers, wherein each of the at least three pairs of low level controllers receives a change in a target set point as an input and generates a change in a control action as an output.

5. The system according to claim 4, wherein one pair of the at least three pairs of low level controllers receives lime saturation factor as the input, a second pair of the at least three pairs of low level controllers receives alumina modulus as the input, and a third pair of the at least three pairs of low level controllers receives silica modulus as the input.

6. The system according to claim 5, wherein each low level controller in a pair of the at least three pairs of low level controllers generates a change in a control action as an output.

7. The system according to claim 6, further comprising a summer coupled to the at least three pairs of low level controllers for summing all of the change in control actions generated therefrom.

8. The system according to claim 7, wherein the summer comprises at least three summers, wherein a first summer sums a first component of the change in control actions from each of the at least three pairs of low level controllers, a second summer sums a second component of the change in control actions from each of the at least three pairs of low level controllers, and a third summer sums the change in control actions from both the first and second summer.

9. The system according to claim 1, wherein each of the plurality of low level controllers are fuzzy logic proportional integral controllers.

10. The system according to claim 1, wherein the system further comprises a raw mill, coupled to the mixer for grinding and blending the mix of the plurality of raw material into a raw mix.

11. The system according to claim 10, wherein the system further comprises a kiln, coupled to the raw mill for burning the raw mix.

12. A method for providing raw mix proportioning control in a cement plant, comprising:

providing a plurality of raw material;

transporting the plurality of raw material with a plurality of transport belts to a mixer;

controlling the proportions of the plurality of raw material transported along the plurality of transport belts to the mixer, comprising:

obtaining a plurality of target set points;

obtaining the composition of the plurality of raw material;

performing fuzzy logic supervisory control on the plurality of target set points and the composition of the plurality of raw material, the performing fuzzy logic supervisory control comprising using a plurality of low level controllers, wherein each low level controller receives a change in a target set point as an input and generates a change in a control action as an output; and determining the proportions of the plurality of raw material transported along the plurality of transport belts to the mixer according to the fuzzy logic supervisory control; and mixing the determined proportions of the plurality of raw material with the mixer.

13. The method according to claim 12, further comprising providing the mix of the plurality of raw material from the mixer to a raw mill and generating a raw mix therefrom.

14. The method according to claim 13, further comprising providing the raw mix from the raw mill to a kiln.

15. The method according to claim 12, wherein the plurality of raw material comprise limestone, sandstone and sweetener.

16. The method according to claim 12, wherein the plurality of target set points are physical properties comprising lime saturation factor, alumina modulus and silica modulus.

17. The method according to claim 12, wherein performing fuzzy logic supervisor control further comprises using at least three pairs of low level controllers, wherein each of the at least three pairs of low level controllers receives a change in a target set point as an input and generates a change in a control action as an output.

18. The method according to claim 17, wherein one pair of the at least three pairs of low level controllers receives lime saturation factor as the input, a second pair of the at least three pairs of low level controllers receives alumina modulus as the input, and a third pair of the at least three pairs of low level controllers receives silica modulus as the input.

19. The method according to claim 18, wherein each low level controller in a pair of the at least three pairs of low level controllers generates a change in a control action as an output.

20. The method according to claim 19, further comprising summing all of the change in control actions from the at least three pairs of low level controllers.

21. The method according to claim 20, wherein the summing comprises using at least three summers, wherein a first summer sums a first component of the change in control actions from each of the at least three pairs of low level controllers, a second summer sums a second component of the change in control actions from each of the at least three pairs of low level controllers, and a third summer sums the change in control actions from both the first and second summer.

22. The method according to claim 1, wherein each of the plurality of low level controllers are fuzzy logic proportional integral controllers.

* * * * *